US011348414B2

(12) United States Patent
Hwang et al.

(10) Patent No.: US 11,348,414 B2
(45) Date of Patent: May 31, 2022

(54) AUTOMATED TELLER MACHINE

(71) Applicant: HYOSUNG TNS INC., Seoul (KR)

(72) Inventors: Jin Young Hwang, Seoul (KR); Seok Won Kim, Gyeonggi-do (KR); Kyoung Soo Kim, Gyeonggi-do (KR); Seung Soo Lee, Gyeonggi-do (KR); Young Dae Seo, Gyeonggi-do (KR)

(73) Assignee: HYOSUNG TNS INC., Seoul (KR)

( * ) Notice: Subject to any disclaimer, the term of this patent is extended or adjusted under 35 U.S.C. 154(b) by 132 days.

(21) Appl. No.: 17/017,728

(22) Filed: Sep. 11, 2020

(65) Prior Publication Data

US 2021/0074130 A1 Mar. 11, 2021

(30) Foreign Application Priority Data

Sep. 11, 2019 (KR) ..... 10-2019-0112647

(51) Int. Cl.
*G07F 19/00* (2006.01)

(52) U.S. Cl.
CPC ..... *G07F 19/203* (2013.01); *G07F 19/202* (2013.01)

(58) Field of Classification Search
CPC ..... G07F 19/203; G07F 19/202
USPC ..... 221/256
See application file for complete search history.

(56) References Cited

U.S. PATENT DOCUMENTS 3,880,320 A * 4/1975 Morello ..... G07F 19/203 221/9
4,980,543 A * 12/1990 Hara ..... G07F 19/202 235/379
2008/0142583 A1* 6/2008 Yokoi ..... B65H 31/3027 235/379
2009/0101467 A1* 4/2009 Moon ..... G07D 11/14 194/206
2012/0324278 A1* 12/2012 Dent ..... G07F 19/20 714/14
2019/0304262 A1* 10/2019 Day ..... G07D 11/16
2020/0074815 A1* 3/2020 Burke ..... G07F 19/203

* cited by examiner

*Primary Examiner* — Daniel A Hess
(74) *Attorney, Agent, or Firm* — Bacon & Thomas, PLLC

(57) ABSTRACT

Provided is an automated teller machine which effectively prevents a banknote from being blown away by wind when a banknote is input or withdrawn through an input-output unit of the automated teller machine. The automated teller machine includes an input-output unit which includes an inlet in which a banknote accommodation space is formed so that a banknote to be input or withdrawn is loaded therein and through which external wind is introduced, a movement path through which the external wind introduced through the inlet passes, and an outlet through which the wind that passes through the movement path is discharged to an upper surface of the loaded banknote.

12 Claims, 13 Drawing Sheets

PRIOR ART

C-C

C-C

AUTOMATED TELLER MACHINE

CROSS-REFERENCE TO RELATED APPLICATION

This application claims priority to and the benefit of Korean Patent Application No. 10-2019-0112647, filed on Sep. 11, 2019, the disclosure of which is incorporated herein by reference in its entirety.

BACKGROUND

1. Field of the Invention

The present invention relates to an automated teller machine, and more specifically, to an automated teller machine which allows banknotes to be effectively prevented from being blown away out of an input-output unit of the automated teller machine.

2. Discussion of Related Art

Automated teller machines are unmanned terminals which allow a user to perform deposit and withdrawal transactions using cash, checks, or the like, transfer money between accounts, and check a bank account using a cash card or a bankbook issued by a financial institution without time constraints and are widely used in the banking industry to quickly process user's financial tasks.

As shown in FIG. 1, a front part 1 of an automated teller machine generally includes a display unit that shows transaction information, a bankbook and card input unit for processing various financial tasks, and an input-output unit 2 which includes a statement issuing unit, and a banknote storage space into which a banknote is input or from which a banknote is received.

In the case of the automated teller machine installed outdoors, when a customer inserts a banknote into the input-output unit 2 or withdraws a banknote loaded in the input-output unit 2, as indicated by the arrow in FIG. 1, the banknote loaded in the banknote storage space may be blown away in a windy outdoor environment.

In this case, since the banknote loaded in the banknote storage space may not be maintained in an arranged state, when the banknotes are transferred in the automated teller machine, a machine failure occurs in the automated teller machine due to skew in which the banknote is inclined to one side. When the banknote comes out of the banknote storage space and is blown away by wind, a problem of inconvenience of use of the automated teller machine may occur.

Conventionally, a windshield cover is installed to protrude outward from both sides of the input-output unit to prevent a banknote from being blown away due to the influence of wind, but the component alone has a limit in effectively preventing a banknote from being blown away by wind. A related art related to an automated teller machine for preventing a banknote from being blown away is shown in Korean Utility Model Registration No. 20-0178878.

SUMMARY OF THE INVENTION

The present invention is directed to providing an automated teller machine which allows a banknote to be effectively prevented from being blown away by wind when a banknote is input into or withdrawn from an input-output unit of the automated teller machine.

According to an aspect of the present invention, there is provided an automated teller machine which includes an input-output unit, which includes inlets in which a banknote accommodation space is formed so that a banknote to be input or withdrawn is loaded therein and through which external wind is introduced, a movement path through which the wind that is introduced through the inlet passes, and outlets through which the wind that passes through the movement path is discharged to an upper surface of the loaded banknote so that the banknote accommodated in the banknote accommodation space is maintained in a loaded state without being blown away.

The inlets may be provided on both sides of the input-output unit, the movement path may be provided to be divided to correspond to both sides of an inner and upper portion of the input-output unit, and the outlets may be provided on both sides of a lower portion of the movement path to be spaced apart from each other so that wind discharged through the outlets flows toward both sides of the upper surface of the loaded banknote.

The input-output unit may further include an induction part which induces the wind, which is discharged through the outlets, to be concentrated toward upper surfaces of both side portions of the loaded banknote.

The induction part may be provided in a protruding form to be convex downward in an area between the outlets provided at positions of both of the sides spaced apart from each other.

The input-output unit may include a path forming part for inducing the wind, which is introduced through the inlet, to the movement path.

A banknote seating part may be provided on a lower portion of the banknote accommodation space, and escape preventing protrusions may be provided on both sides of a front portion of the banknote seating part to protrude upward by a predetermined length so as to prevent the banknote loaded on the banknote seating part from coming out in a forward direction.

A banknote transferring tray may be provided on a lower portion of the banknote accommodation space and support both side portions of the loaded banknote, and both side portions of the banknote loaded on the banknote transferring tray may be pressed on an upper surface of the banknote transferring tray by wind discharged through the outlets so that the banknote is prevented from being blown away.

The outlet may be formed in a lower portion of the movement path to be incised in the form of a slit.

At least a part of the outlet may be formed to be inclined to one side with respect to a horizontal plane to face upper surfaces of both side portions of the loaded banknote.

Guide parts may be provided on both sides of the input-output unit and guide external wind to the inlets.

The guide part may include a lateral part that extends to be inclined forward from each of front end portions of both sides of the input-output unit, an upper part that coves an upper end of the lateral part and an upper portion of the inlet, and a lower part that covers a lower end of the lateral part and a lower portion of the inlet.

Lateral extension parts may be provided on rear end portions of both sides of the input-output unit and coupled to the guide parts to induce external wind to the inlets.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, the configuration and operation of exemplary embodiments of the present invention will be described in detail with reference to the accompanying drawings.

Figure 1:
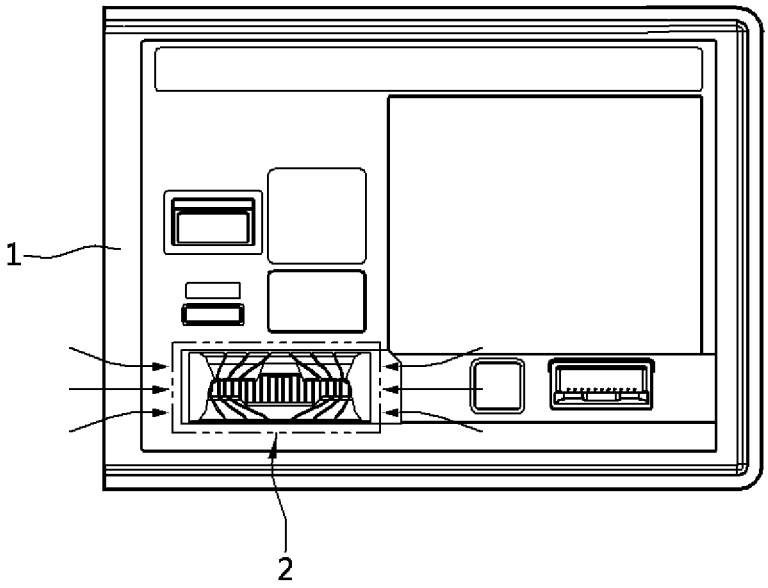
FIG. 1 is a front view illustrating a banknote input-output unit formed on a front part of a conventional automated teller machine.
Figure 2:
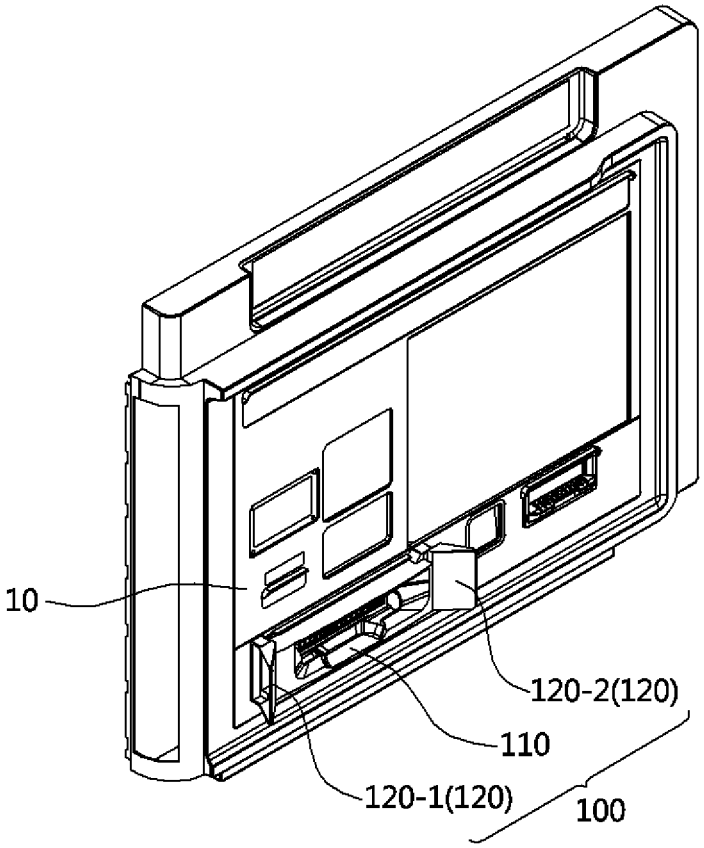
FIG. 2 is a perspective view illustrating a front part of an automated teller machine with a banknote blowing prevention device according to one embodiment of the present invention.
Figure 3:
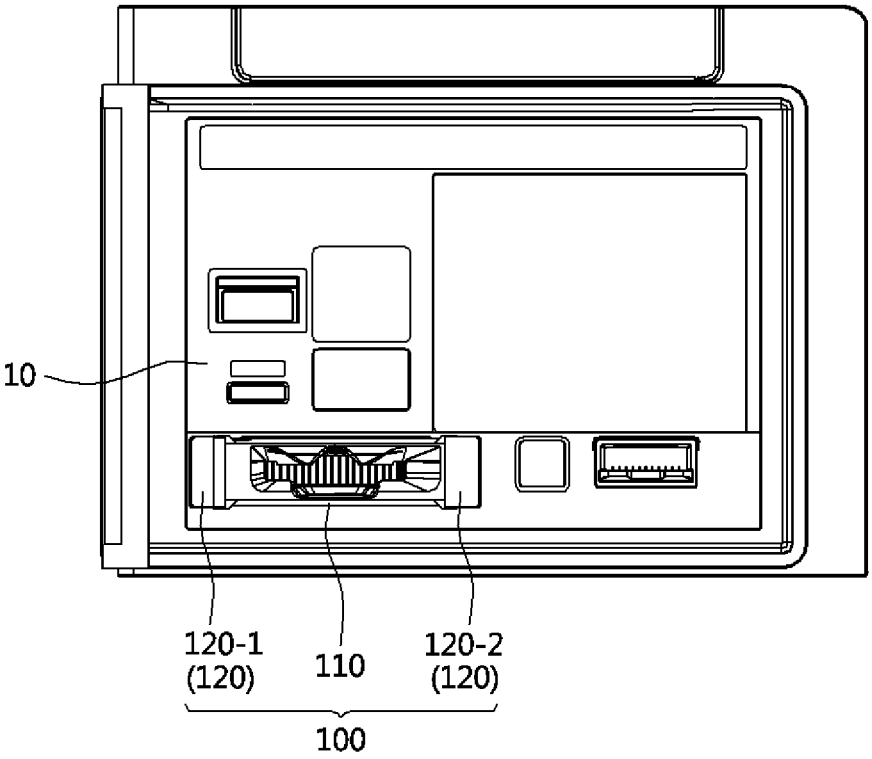
FIG. 3 is a front view illustrating a front part of the automated teller machine with the banknote blowing prevention device according to one embodiment of the present invention.
Figure 4:
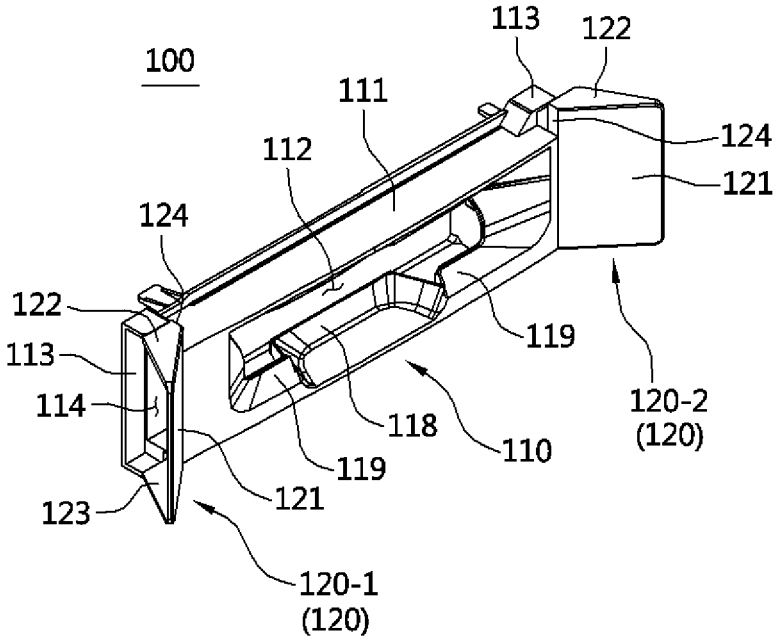
FIG. 4 is a perspective view of the banknote blowing prevention device according to one embodiment of the present invention.
Figure 5:
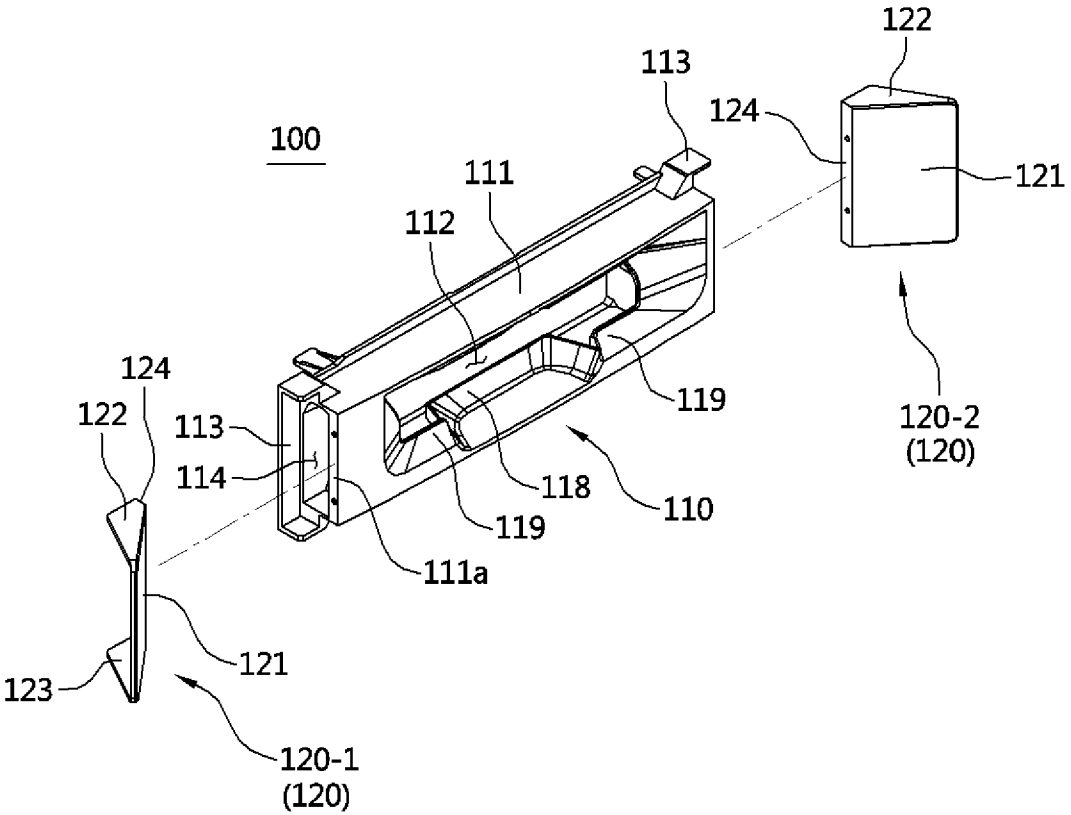
FIG. 5 is an exploded perspective view of the banknote blowing prevention device shown in FIG. 4.
Figure 6:
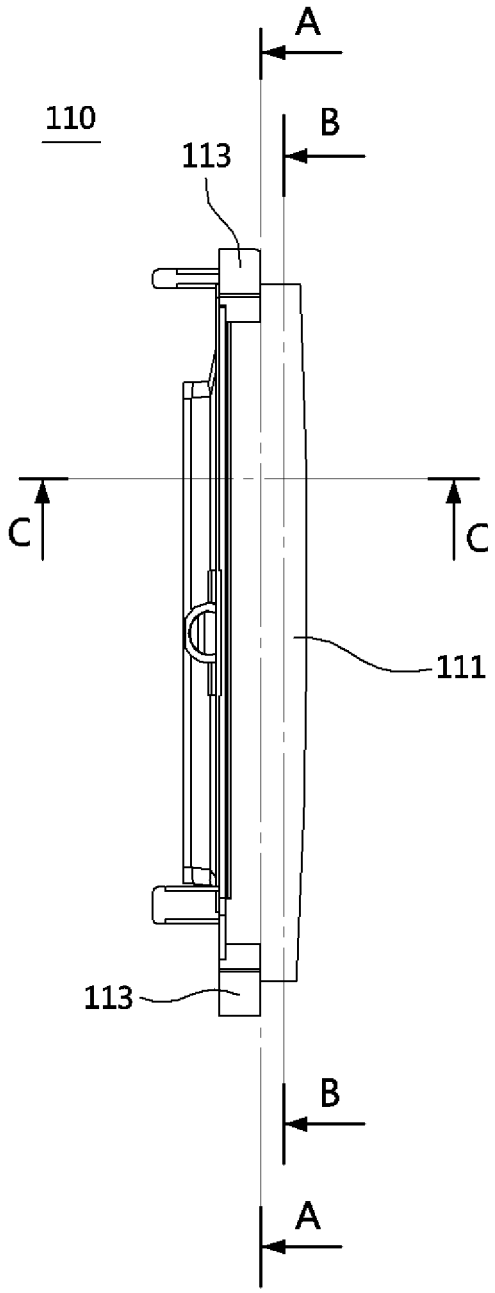
FIG. 6 is a plan view of the banknote blowing prevention device according to one embodiment of the present invention.
Figure 7:
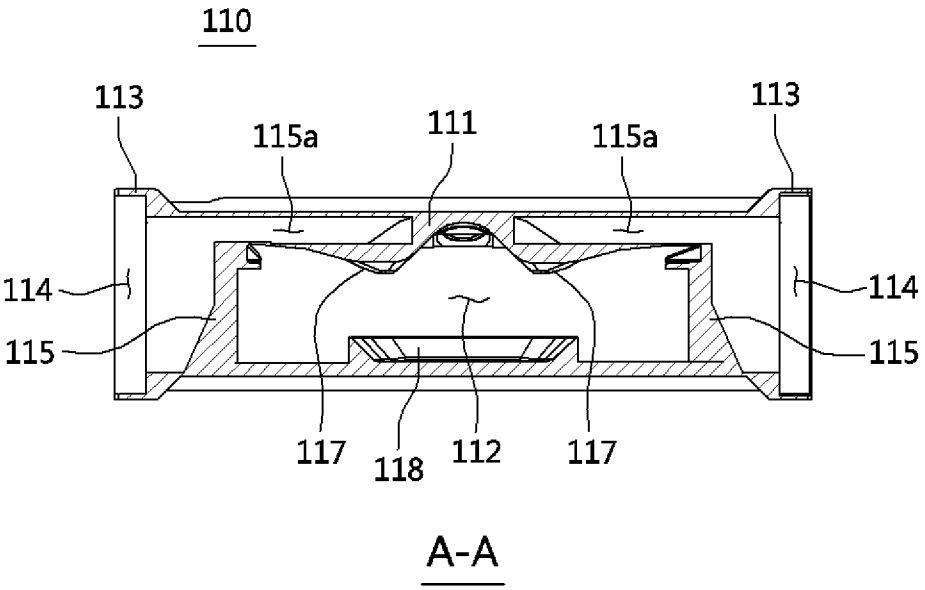
FIG. 7 is a cross-sectional view taken along line A-A in FIG. 6.
Figure 8:
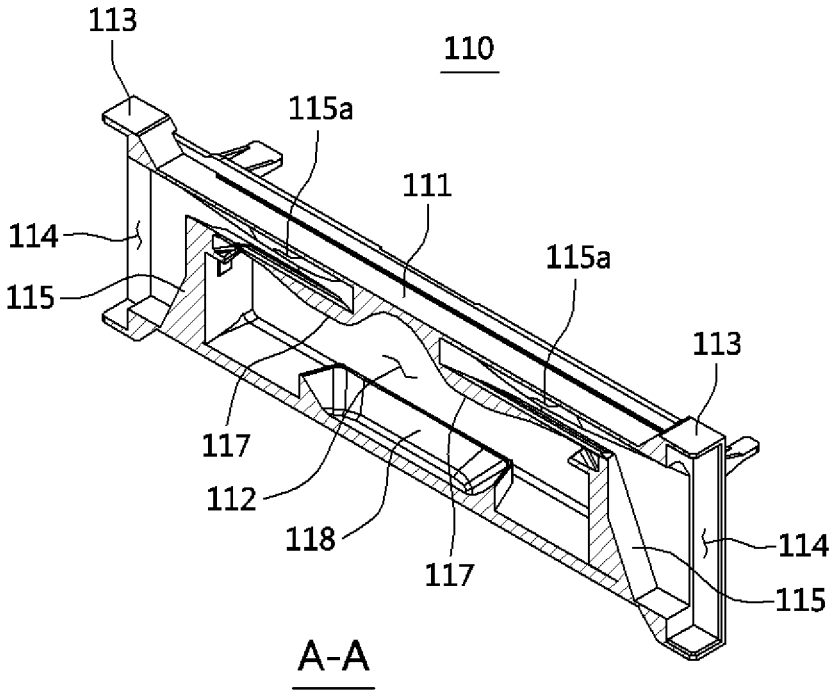
FIG. 8 is a cross-sectional perspective view taken along line A-A in FIG. 6.
Figure 9:
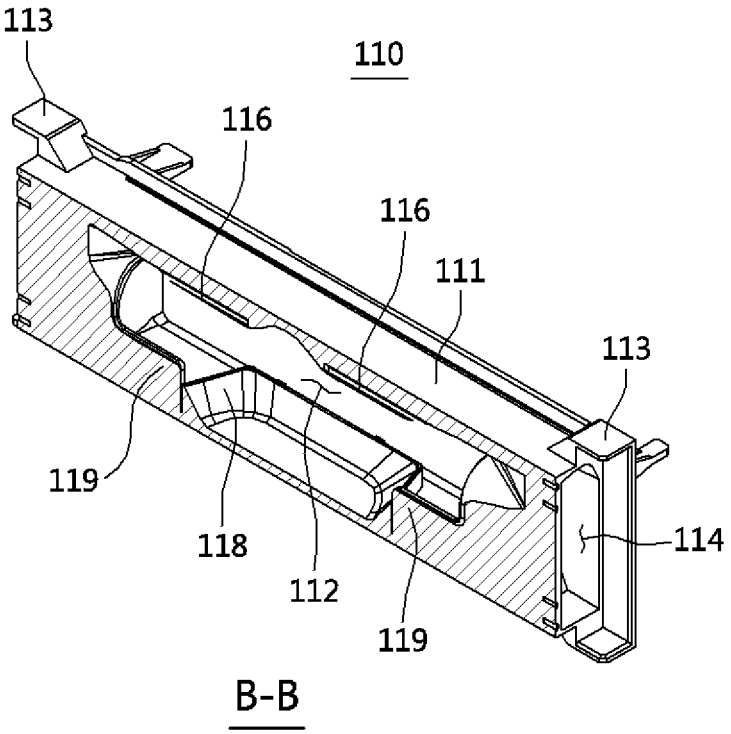
FIG. 9 is a cross-sectional perspective view taken along line B-B in FIG. 6.
Figure 10:
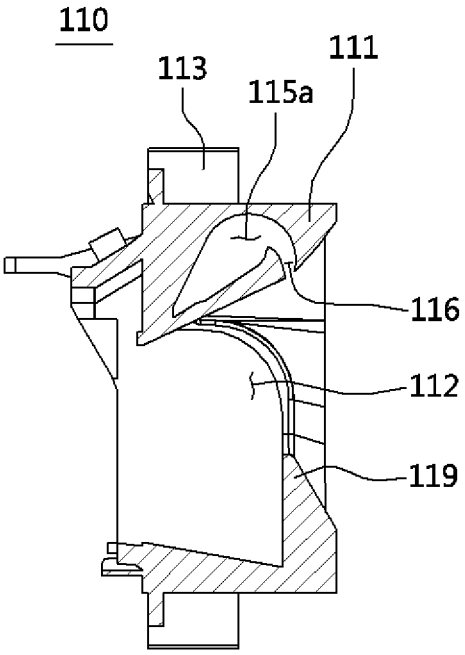
FIG. 10 is a cross-sectional view taken along line C-C in FIG. 6.
Figure 11:
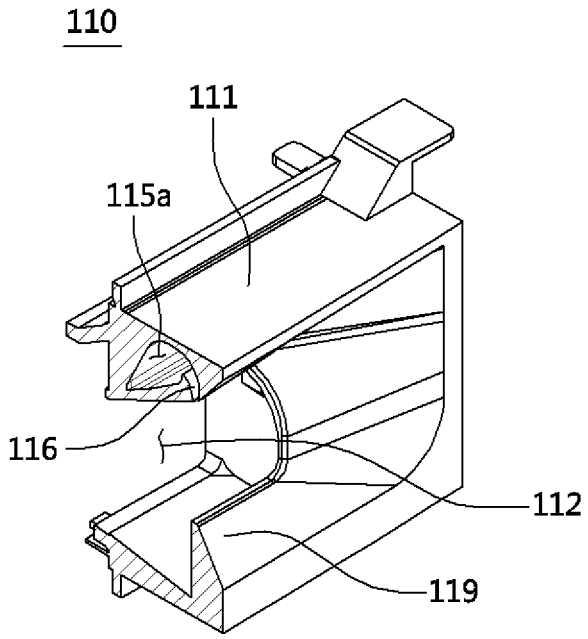
FIG. 11 is a cross-sectional perspective view taken along line C-C in FIG. 6.
Figure 12:
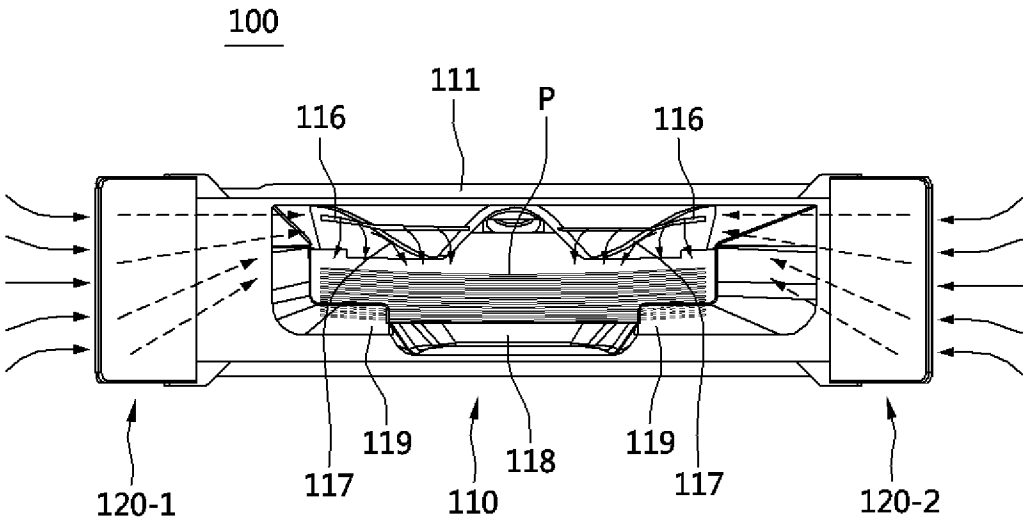
FIG. 12 is a view illustrating a state in which banknotes are prevented from being blown away by the banknote blowing prevention device according to one embodiment of the present invention.

Referring to FIGS. 2 and 3, an automated teller machine including a banknote blowing prevention device 100 according to one embodiment of the present invention includes an input-output unit 110 for a banknote, which is formed on a front part 10 of the automated teller machine for an input and withdrawal of a banknote, and guide parts 120 (120-1 and 120-2*a*) provided on both sides of the input-output unit 110.

Referring to FIGS. 4 to 12, the input-output unit 110 includes a main body 111 including a banknote accommodation space 112 in which a banknote P to be input or withdraw is loaded.

As one embodiment, the banknote P is loaded in the banknote accommodation space 112 in a vertical direction. Inlets 114 into which external wind is introduced are formed on both sides of the main body 111, and lateral extension parts 113 are formed on one portions of the inlets 114 and coupled to the guide parts 120 to induce the external wind to the inlets 114.

The main body 111 may include a path forming part 115 formed therein in an upwardly inclined structure to induce wind, which is introduced through the inlet 114, to movement paths 115*a* formed on an inner and upper portion of the main body 111.

The movement path 115*a* provides a path through which the wind introduced through the inlet 114 passes and is formed in the inner and upper portion of the main body 111 in a transverse direction.

Outlets 116, through which the wind that passes through the movement paths 115*a* is discharged and sprayed downward, are formed on lower portions of the movement paths 115*a*. As one embodiment, the outlets 116 may be formed in lower portions of the movement paths 115*a* to be incised in the form of a slit. However, the outlets 116 may be formed in the form of a plurality of holes.

As another embodiment, the outlets 116 may be formed to be at least partially inclined to one side with respect to a horizontal plane to face upper surfaces of both side portions of the loaded banknote.

Wind discharged downward through the outlets 116 flows toward the upper surfaces of the banknotes P loaded in the banknote accommodation space 112 to press the loaded banknote P downward so as to prevent the banknote P from being blown away.

The input-output unit 110 may further include an induction part 117 for inducing the wind, which is discharged through the outlets 116, to be concentrated toward the upper surfaces of both side portions of the loaded banknote P. The induction part 117 is formed in a structure protruding downward to block wind, which is discharged through the outlets 116, from flowing toward a central portion of the banknote accommodation space 112, thereby inducing the wind to be concentrated toward the upper surfaces of both side portions of the banknote P.

As one embodiment, the inlets 114 are provided on both sides of the input-output unit 110, the movement paths 115*a* are provided in an inner and upper portion of the input-output unit 110 to be divided, and the outlets 116 are provided on both lower side portions of the movement paths 115*a* to be spaced apart from each other. According to the configuration, the wind discharged through the outlets 116 flows toward the upper surfaces of both side portions of the banknote loaded in the banknote accommodation space 112 to suppress both side portions of the banknote from being blown away so as to effectively prevent the banknote from being blown away.

The induction part 117 may be provided to protrude to be convex downward in an area between the outlets 116 provided at positions of both of the sides spaced apart from each other.

A banknote seating part 118 in which a banknote is loaded is provided below the banknote accommodation space 112, and an escape preventing protrusion 119 may be provided on both sides of a front portion of the banknote seating part 118 to protrude upward by a predetermined length so as to prevent the banknote loaded on the banknote seating part 118 from coming out in a forward direction.

The guide parts 120 (120-1 and 120-2) are formed to guide external wind toward the inlets 114, and each of the guide parts include a first guide part 120-1 and a second guide part 120-2 that are symmetrically formed on both sides of the input-output unit 110.

The guide parts 120 may include lateral parts 121 that extend to be inclined forward from front end portions 111*a* on both sides of the input-output unit 110, upper parts 122 that cover upper ends of the lateral parts 121 and upper portions of the inlets 114, and lower parts 123 that cover lower ends of the lateral parts 121 and lower portions of the inlets 114. Coupling parts 124 of the guide parts 120 are coupled to the front end parts 111*a* on both sides of the input-output unit 110 by fastening units (not shown).

The guide parts 120 are coupled to the lateral extension parts 113 provided on both sides of the main body 111, and a guide structure for guiding the external wind to the inlet 114 is formed outside the inlet 114 by the coupling of the guide part 120 and the lateral extension part 113.

Further, the guide part 120 blocks the external wind, which flows in a lateral direction, from flowing toward the front side of the banknote accommodation space 112 so as to prevent the banknote P loaded in the banknote accommodation space from being blown away.

Figure 13:
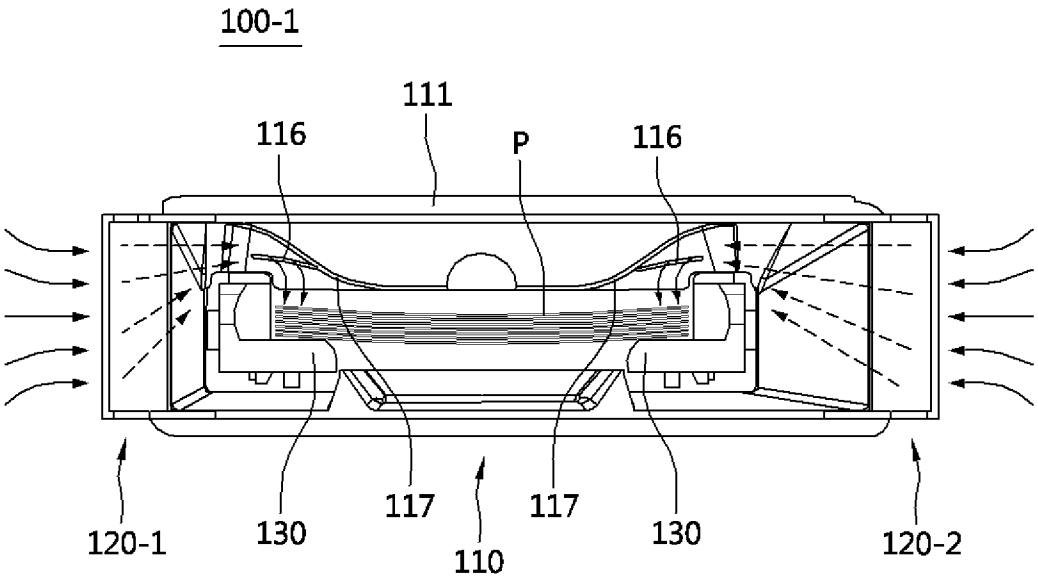
FIG. 13 is a view illustrating a state in which banknotes are prevented from being blown away by a banknote blowing prevention device according to a modified embodiment of the present invention.

Referring to FIG. 13, a banknote blowing prevention device 100-1 according to a modified embodiment may include a banknote transferring tray 130 provided on a lower portion of a banknote accommodation space 112 to support both side portions of a loaded banknote, and both side portions of the banknote loaded on the banknote transferring tray 130 are pressed by wind discharged through outlets 116, and thus blowing of the banknote can be prevented.

According to the present invention, since upper surfaces of the banknote are pressed and supported on a banknote seating part 118 of the banknote accommodation space 112 or an upper surface of the banknote transferring tray 130 by air pressure of wind using external air that causes blowing of the banknote loaded in the banknote accommodation space 112 of the input-output unit 110 of the automated teller machine installed outdoors, the banknote is effectively prevented from being blown away when the banknote is input or withdrawn, and thus convenience of use of the automated teller machine can be increased even in an environment in which the automated teller machine is installed outdoors. Further, the loaded banknote can be maintained in an arranged state, and thus a machine failure due to misalignment of banknotes can be prevented when a banknote is returned when being input into the automated teller machine.

According to the automated teller machine according to the present invention, a path through which wind is introduced to an input-output unit of the automated teller machine, moved, and discharged to an upper surface of a banknote loaded in a banknote accommodation space is formed so that the banknote can be effectively prevented from being blown away by wind when a banknote is input or withdrawn through the input-output unit.

Further, the guide parts are formed on both sides of the input-output unit 110 to prevent wind, which flows toward the input-output unit, from being introduced through a front side of the banknote accommodation space and guide the wind from lateral sides of the input-output unit to inlets formed on both sides of the input-output unit so as to effectively prevent a banknote from being blown away by wind.

Further, wind is discharged to be concentrated toward upper surfaces of both side portions of the banknote loaded in the banknote accommodation space so that both side portions of the banknotes are pressed downward by air pressure of the wind, and thus the banknote can be prevented from being blown away, and a state of the loaded banknote can be maintained stably.

As described above, the present invention is not limited to the above-described embodiments, and obvious modification can be made by a person skilled in the art to which the present invention pertains without departing from the technical spirit of the present invention claimed in the claims, and the modifications are within the scope of the present invention.

What is claimed is:

1. An automated teller machine comprising an input-output unit which includes:

inlets in which a banknote accommodation space is formed so that a banknote to be input or withdrawn is loaded therein and through which external wind is introduced;

a movement path through which the wind that is introduced through the inlet passes; and outlets through which the wind that passes through the movement path is discharged to an upper surface of the loaded banknote so that the banknote accommodated in the banknote accommodation space is maintained in a loaded state without being blown away.

2. The automated teller machine of claim 1, wherein the inlets are provided on both sides of the input-output unit, the movement path is provided to be divided to correspond to both sides of an inner and upper portion of the input-output unit, and the outlets are provided on both sides of a lower portion of the movement path to be spaced apart from each other so that wind discharged through the outlets flows toward both side portions of the upper surface of the loaded banknote.

3. The automated teller machine of claim 2, wherein the input-output unit further includes an induction part which induces the wind, which is discharged through the outlets, to be concentrated toward upper surfaces of both side portions of the loaded banknote.

4. The automated teller machine of claim 3, wherein the induction part is provided in a protruding form to be convex downward in an area between the outlets provided at positions of both of the sides spaced apart from each other.

5. The automated teller machine of claim 2, wherein the input-output unit includes a path forming part for inducing the wind, which is introduced through the inlet, to the movement path.

6. The automated teller machine of claim 2, wherein a banknote seating part is provided on a lower portion of the banknote accommodation space, and escape preventing protrusions are provided on both sides of a front portion of the banknote seating part to protrude upward by a predetermined length so as to prevent the banknote loaded on the banknote seating part from coming out in a forward direction.

7. The automated teller machine of claim 2, wherein a banknote transferring tray is provided on a lower portion of the banknote accommodation space and supports both side portions of the loaded banknote, and both side portions of the banknote loaded on the banknote transferring tray are pressed on an upper surface of the banknote transferring tray by wind discharged through the outlets so that the banknote is prevented from being blown away.

8. The automated teller machine of claim 2, wherein the outlet is formed in a lower portion of the movement path to be incised in the form of a slit.

9. The automated teller machine of claim 8, wherein at least a part of the outlet is formed to be inclined to one side with respect to a horizontal plane to face upper surfaces of both side portions of the loaded banknote.

10. The automated teller machine of claim 2, wherein guide parts are provided on both sides of the input-output unit and guide external wind to the inlets.

11. The automated teller machine of claim 10, wherein the guide part includes:

a lateral part that extends to be inclined forward from each of front end portions of both sides of the input-output unit;

an upper part that coves an upper end of the lateral part and an upper portion of the inlet; and a lower part that covers a lower end of the lateral part and a lower portion of the inlet.

12. The automated teller machine of claim 11, wherein lateral extension parts are provided on rear end portions of both sides of the input-output unit and coupled to the guide parts to induce external wind to the inlets.

* * * * *